US012492043B1

(12) United States Patent
Michael et al.

(10) Patent No.: US 12,492,043 B1
(45) Date of Patent: Dec. 9, 2025

(54) MAGNETIC POUCH

(71) Applicant: DIFFERENT TAKES, LLC, New York City, NY (US)

(72) Inventors: Agastin Michael, New York City, NY (US); Nelson Lin, New York City, NY (US)

( * ) Notice: Subject to any disclaimer, the term of this patent is extended or adjusted under 35 U.S.C. 154(b) by 65 days.

(21) Appl. No.: 18/436,087

(22) Filed: Feb. 8, 2024

(51) Int. Cl.
*B65D 33/14* (2006.01)
*A45F 5/02* (2006.01)
*B65D 33/16* (2006.01)

(52) U.S. Cl.
CPC ..... *B65D 33/14* (2013.01); *A45F 5/02* (2013.01); *B65D 33/1658* (2013.01)

(58) Field of Classification Search
CPC ..... B65D 33/14; B65D 33/1658; A45F 5/02
USPC ..... 383/11, 81–83
See application file for complete search history.

(56) References Cited

U.S. PATENT DOCUMENTS 3,647,056 A 3/1972 Jacobson et al.
4,255,837 A * 3/1981 Holtz ..... B42F 11/04 40/658
5,682,653 A * 11/1997 Berglof ..... G09F 1/10 224/183
6,131,205 A 10/2000 Arem
6,571,997 B2 6/2003 Dedrick
8,646,971 B2 2/2014 Doyle
9,510,655 B2 12/2016 Stratton
D904,832 S 12/2020 Santos et al.
11,696,634 B2 7/2023 Schori
11,805,863 B1 * 11/2023 Decker ..... A45C 13/1069
2006/0151340 A1 * 7/2006 Meister ..... B65D 27/20 206/232
2006/0282989 A1 12/2006 Dietz
2008/0037907 A1 * 2/2008 Suskind ..... B65D 33/30 383/26
2009/0014105 A1 * 1/2009 Shattuck ..... A45F 5/02 224/183
2009/0283197 A1 * 11/2009 Gorodisher ..... A45C 13/1069 156/60
2010/0157237 A1 * 6/2010 Mor ..... A45C 11/04 351/155
2013/0098954 A1 4/2013 Inglis
2013/0220694 A1 8/2013 Whittman
2014/0312083 A1 10/2014 Scott
2015/0157154 A1 6/2015 Rothenberg
2020/0391906 A1 12/2020 Morrison
(Continued)

FOREIGN PATENT DOCUMENTS

AU 2016100418 A4 * 5/2016 ..... A45F 5/1516
CH 716769 A2 * 5/2021 ..... A45C 11/04
(Continued)

*Primary Examiner* — Jes F Pascua

(57) ABSTRACT

The magnetic pouch includes a front wall, a rear wall, and a plurality of magnets. The front wall may be coupled to the rear wall along three edges to form a pouch with an open top. The plurality of magnets may couple the pouch to a host object. The pouch may carry an item such that the item is accessible for use by lifting the item from the pouch. The magnetic pouch may be operable as a clip by folding the pouch in half such that a magnet in the upper half of the rear wall positioned on one side of a container may be attracted to a magnet in the lower half of the rear wall positioned on the opposite side of the container.

22 Claims, 9 Drawing Sheets

(56) References Cited

U.S. PATENT DOCUMENTS

| | | | | |
|---|---|---|---|---|
| 2021/0307495 | A1* | 10/2021 | Schori | A41F 1/002 |
| 2023/0158379 | A1 | 5/2023 | Hong | |

FOREIGN PATENT DOCUMENTS

| | | | | | |
|---|---|---|---|---|---|
| EP | 3162247 | A1 * | 5/2017 | A45F 5/1575 |
| KR | 20230000703 | U * | 4/2023 | A45C 13/30 |
| WO | 2017177255 | | 10/2017 | |

* cited by examiner

MAGNETIC POUCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of storage devices and clip fasteners, more specifically, a magnetic pouch.

SUMMARY OF INVENTION

The magnetic pouch may comprise a front wall, a rear wall, and a plurality of magnets. The front wall may be coupled to the rear wall along three edges to form a pouch with an open top. The plurality of magnets may couple the pouch to a host object. The pouch may carry an item such that the item is accessible for use by lifting the item from the pouch. The magnetic pouch may be operable as a clip by folding the pouch in half such that a magnet in the upper half of the rear wall positioned on one side of a container may be attracted to a magnet in the lower half of the rear wall positioned on the opposite side of the container. As a non-limiting example, the container may be a paper bag.

An object of the invention is to provide a pouch that may be coupled to a host object.

Another object of the invention is to provide a pouch that may couple to a host object that is ferromagnetic via a plurality of pouch magnets.

A further object of the invention is to a non-ferromagnetic object via attraction between a plurality of retainer magnets and the plurality of pouch magnets.

Yet another object of the invention is to provide a pouch that may be used as a clip to hold a container closed.

These together with additional objects, features and advantages of the magnetic pouch will be readily apparent to those of ordinary skill in the art upon reading the following detailed description of the presently preferred, but nonetheless illustrative, embodiments when taken in conjunction with the accompanying drawings.

In this respect, before explaining the current embodiments of the magnetic pouch in detail, it is to be understood that the magnetic pouch is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the magnetic pouch.

It is therefore important that the claims be regarded as including such equivalent construction insofar as they do not depart from the spirit and scope of the magnetic pouch. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
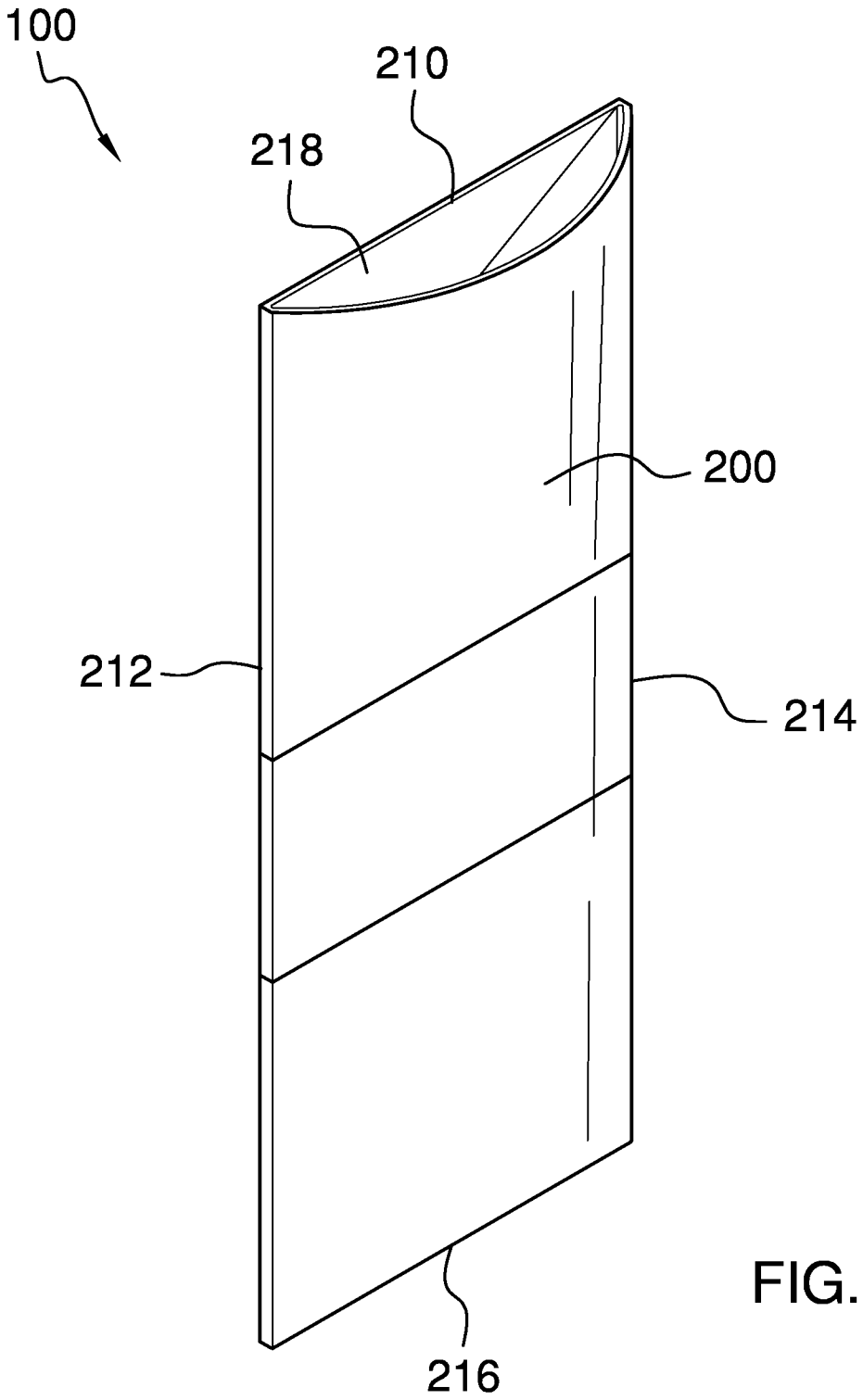
FIG. 1 is a front isometric view of an embodiment of the disclosure.
Figure 2:
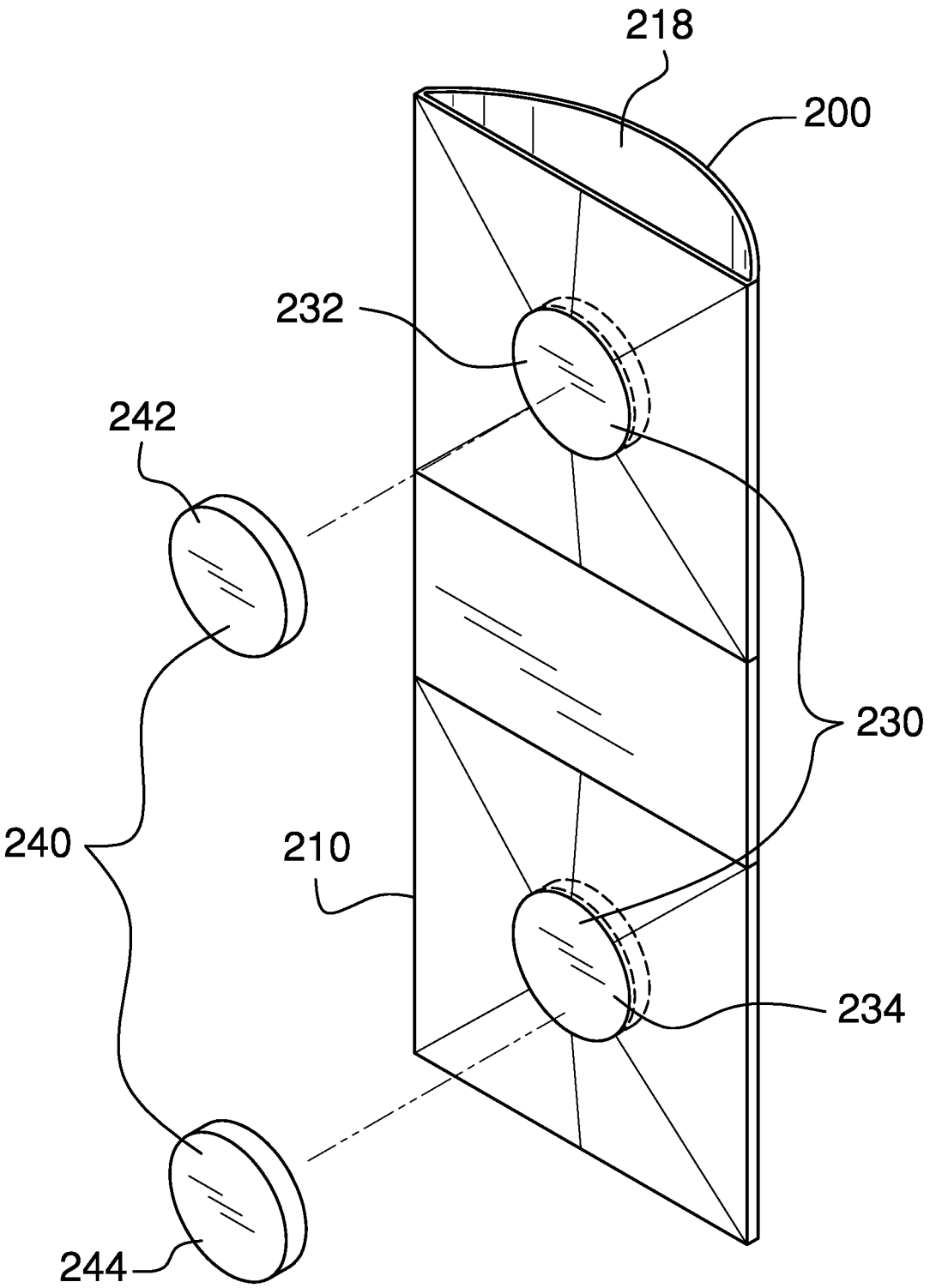
FIG. 2 is a rear isometric view of an embodiment of the disclosure.
Figure 3:
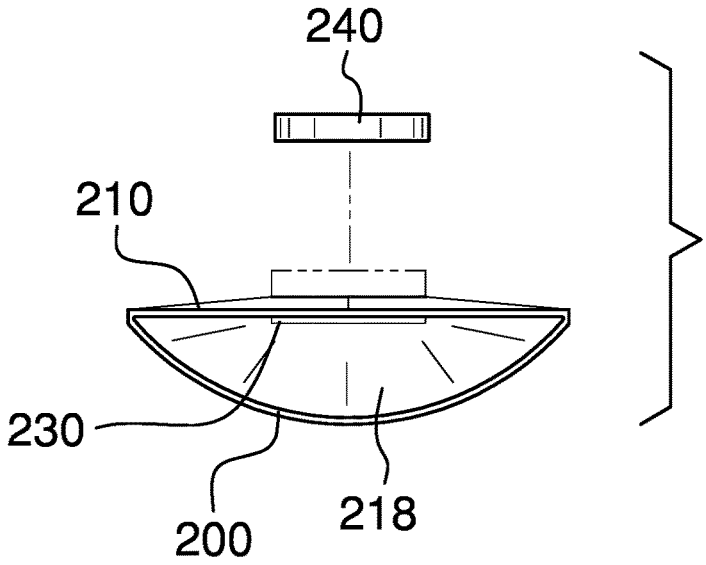
FIG. 3 is a top view of an embodiment of the disclosure.
Figure 4:
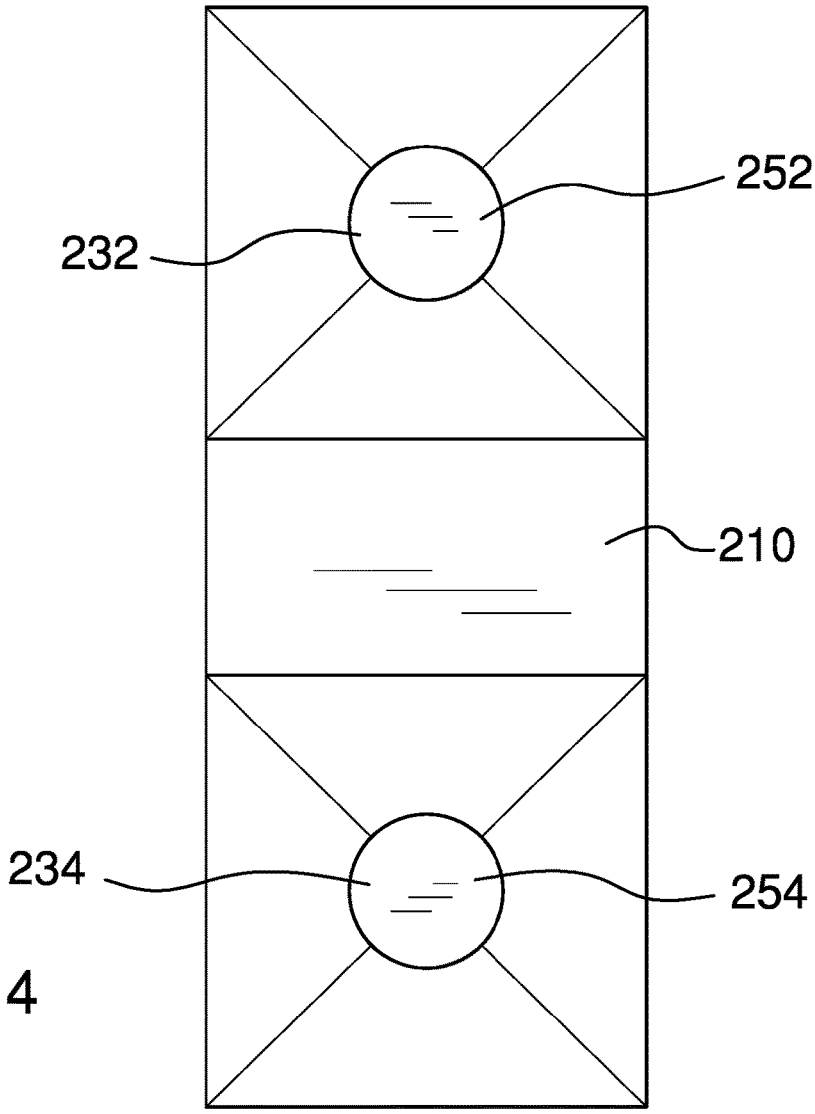
FIG. 4 is a rear view of an embodiment of the disclosure.
Figure 5:
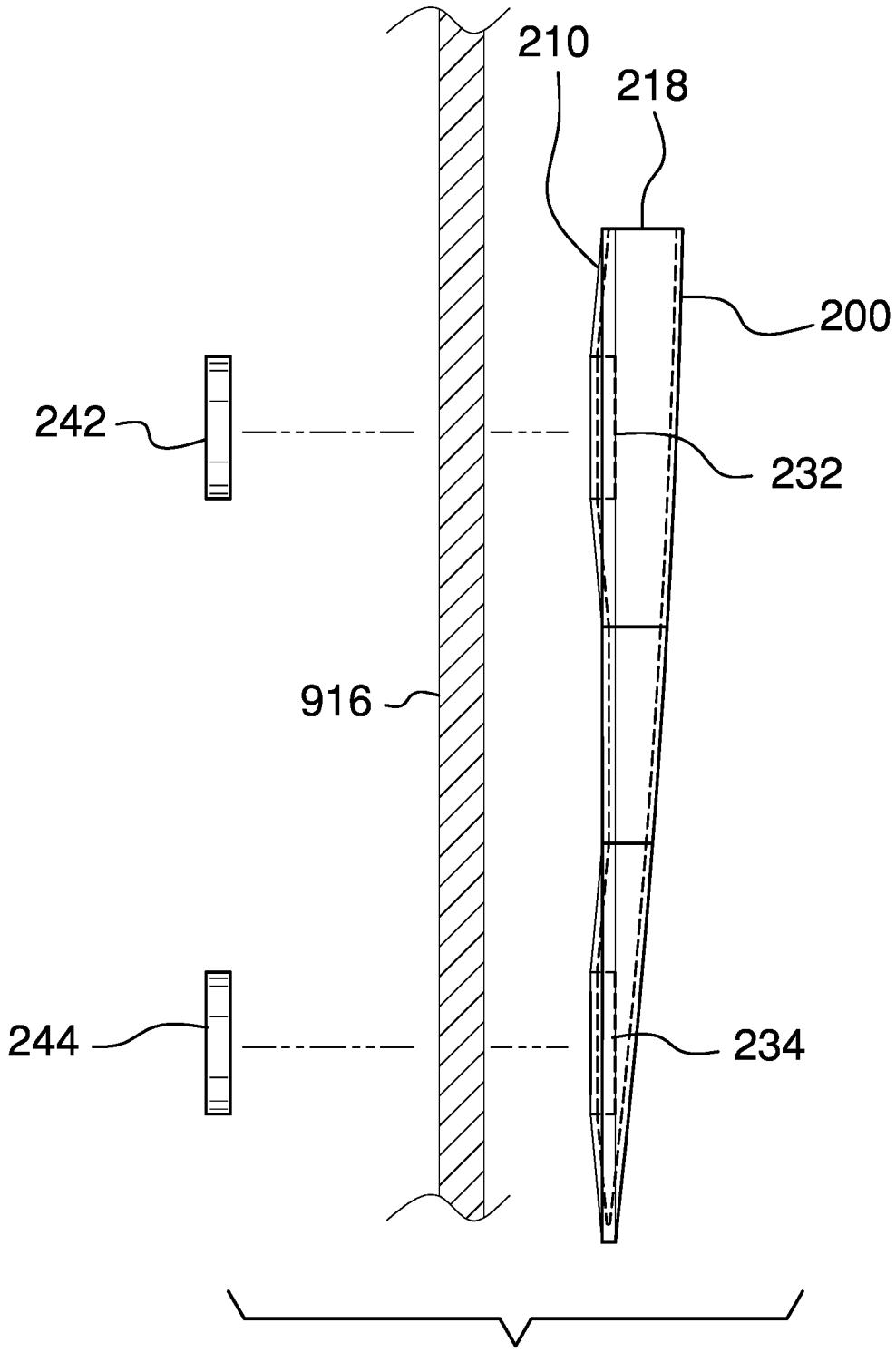
FIG. 5 is a side in-use view of an embodiment of the disclosure.
Figure 6:
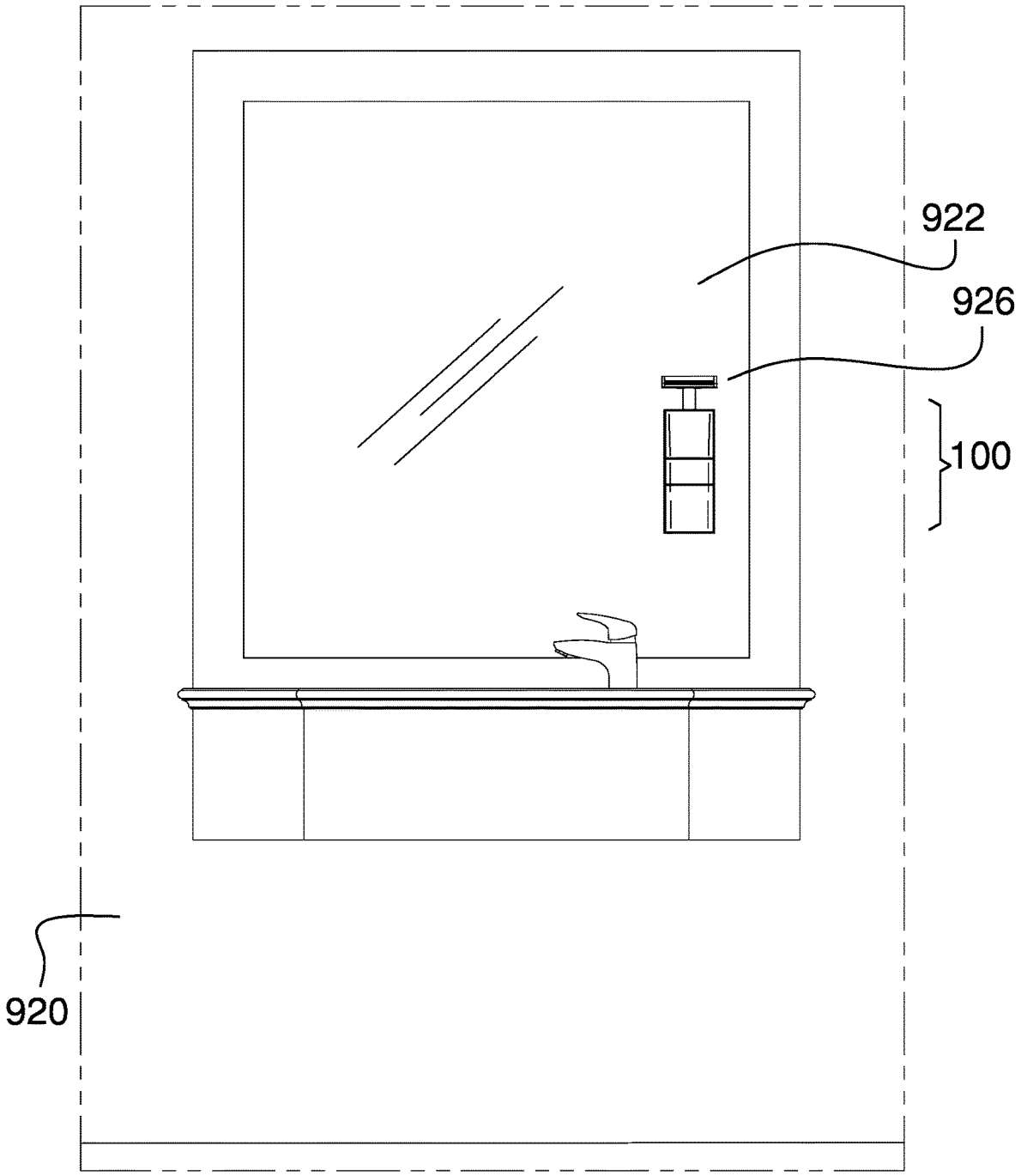
FIG. 6 is an in-use view of an embodiment of the disclosure, illustrating the invention coupled to a bathroom mirror.
Figure 7:
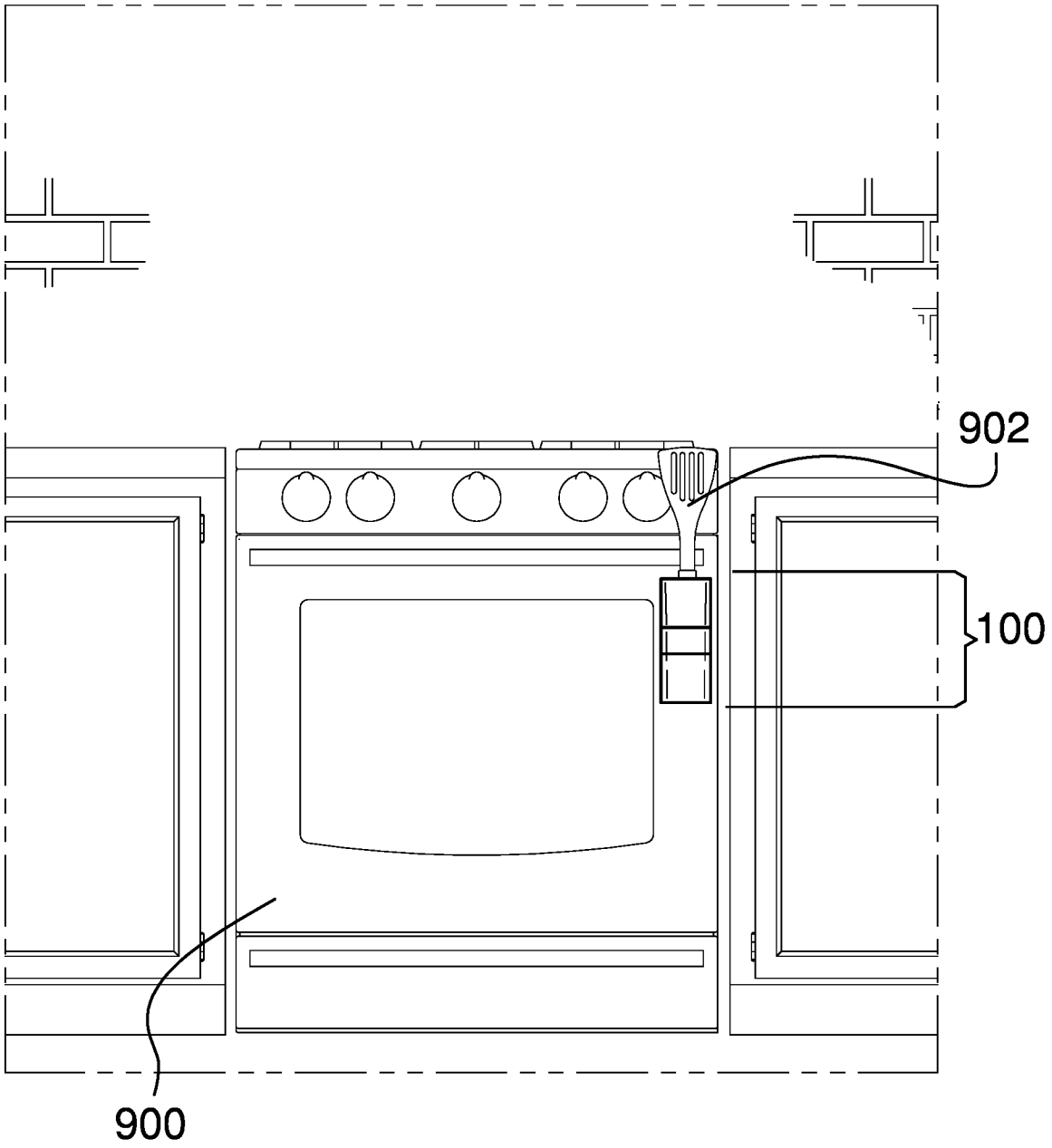
FIG. 7 is an in-use view of an embodiment of the disclosure, illustrating the invention coupled to a kitchen appliance, illustrating the invention coupled to a garment for use as a pocket protector.
Figure 8:
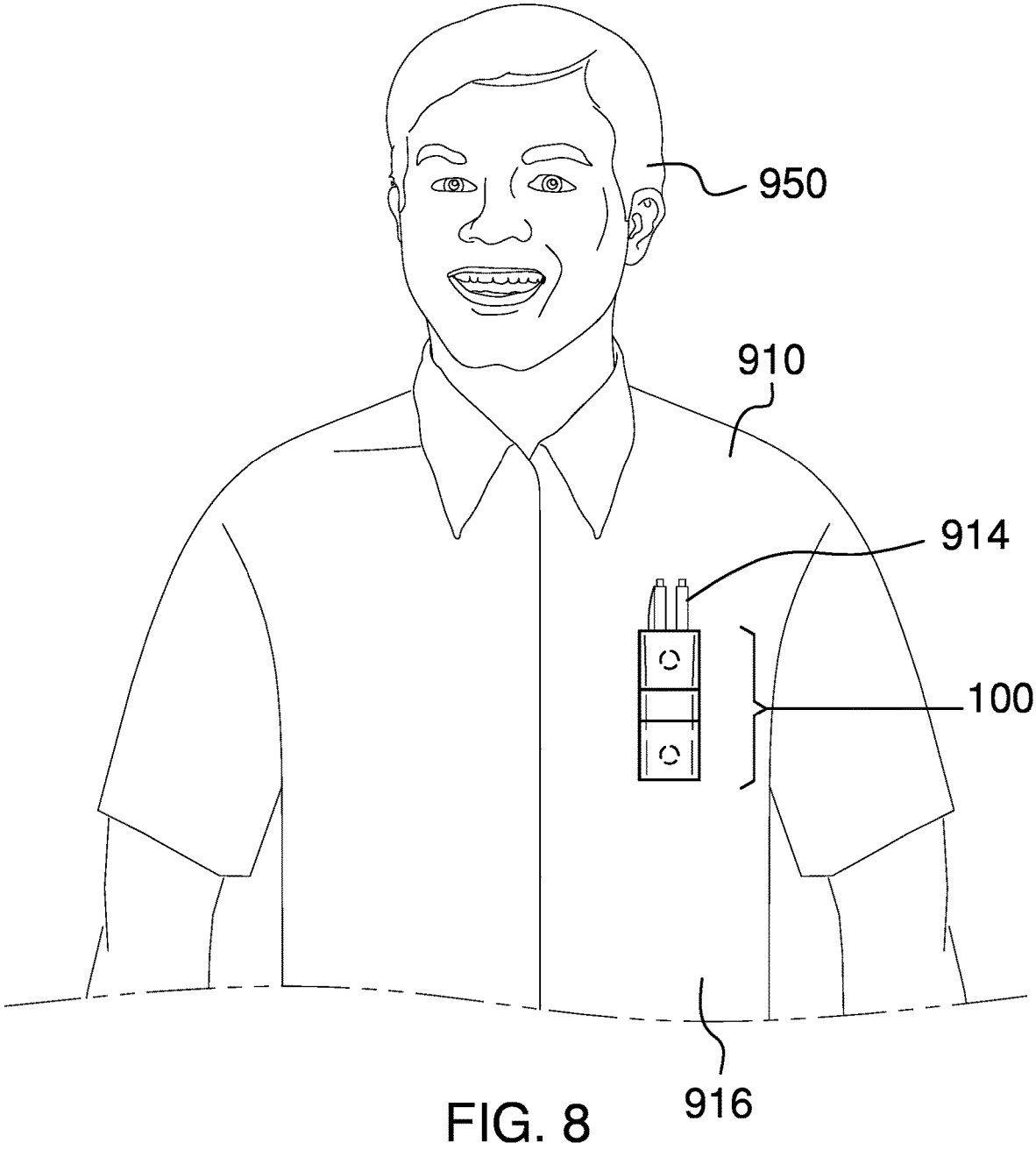
FIG. 8 is an in-use view of an embodiment of the disclosure.
Figure 9:
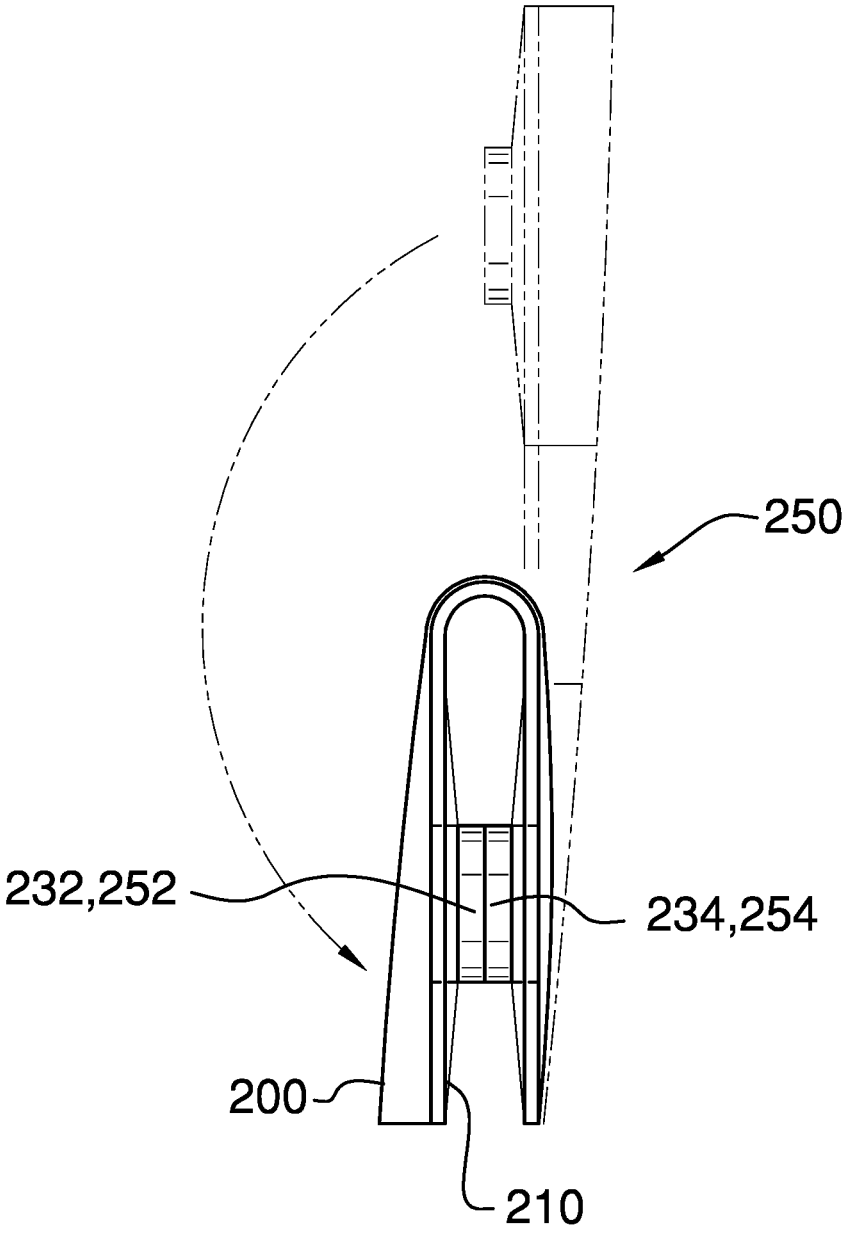
FIG. 9 is a side view of an embodiment of the disclosure, illustrating the pouch folded in half for use as a clip.
Figure 10:
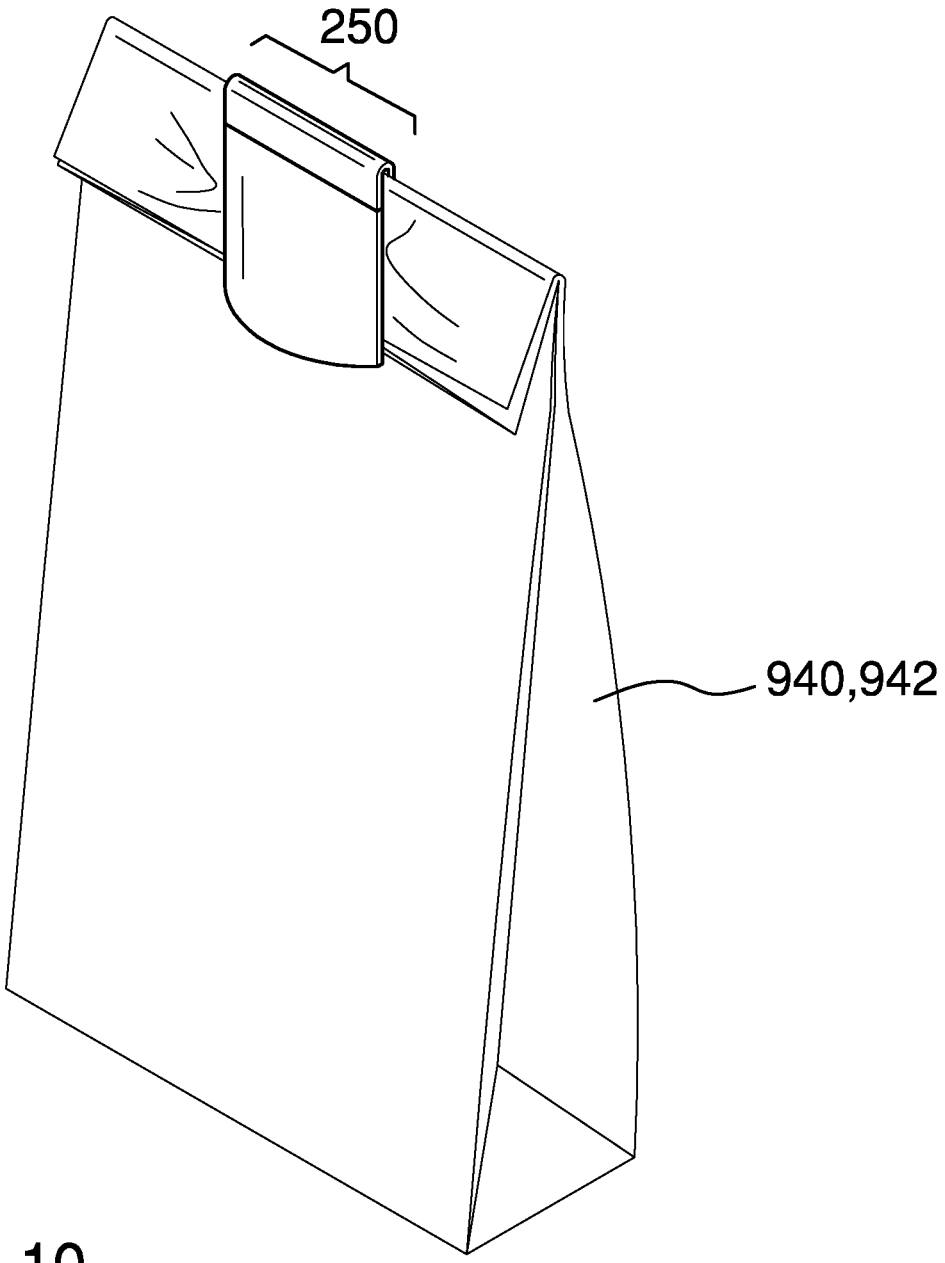
FIG. 10 is an in-use view of an embodiment of the disclosure, illustrating the clip in position on a paper bag.

Detailed reference will now be made to a first potential embodiment of the disclosure, which is illustrated in FIGS. 1 through 10.

The magnetic pouch 100 (hereinafter invention) comprises a front wall 200, a rear wall 210, and a plurality of magnets. The front wall 200 may be coupled to the rear wall 210 along three edges to form a pouch with an open top 218. The plurality of magnets may couple the pouch to a host object. The pouch may carry an item such that the item is accessible for use by lifting the item from the pouch. The invention 100 may be operable as a clip 250 by folding the pouch in half such that a magnet in the upper half 252 of the rear wall 210 positioned on one side of a container 940 may be attracted to a magnet in the lower half 254 of the rear wall 210 positioned on the opposite side of the container 940. As a non-limiting example, the container 940 may be a paper bag 942.

The front wall 200 and the rear wall 210 may be rectangular panels. The height of the front wall 200 may be at least twice as large as the width of the front wall 200. The dimensions of the rear wall 210 may conform to the dimensions of the front wall 200. The front wall 200 and the rear wall 210 may be made from one or more semi-rigid materials. The front wall 200 may be coupled to the rear wall 210 along a left edge 212, a right edge 214, and a bottom edge 216 such that the front wall 200 and the rear wall 210 form the pouch and the open top 218.

In some embodiments, the front wall 200, the rear wall 210, or both may be made from a non-opaque material. As non-limiting examples, the front wall 200, the rear wall 210, or both may be transparent or translucent.

In some embodiments, the front wall 200, the rear wall 210, or both may be made from vinyl, silicone, polyvinyl chloride, polypropylene, polycarbonate, or any combination thereof. In a preferred embodiment, the pouch formed by the front wall 200 and the rear wall 210 may measure 125 mm+/−20 mm high by 50 mm+/−10 mm wide.

The plurality of magnets may comprise a plurality of pouch magnets 230 that may be coupled to the rear wall 210 of the pouch. The plurality of pouch magnets 230 may detachably couple the pouch to a ferromagnetic surface of the host object by magnetically attracting the ferromagnetic surface. The pouch may be magnetically coupled to the host object in a vertical orientation with the open top 218 positioned at the top of the pouch. The plurality of pouch magnets 230 may comprise a pouch clasping magnet 232 and a pouch stabilizing magnet 234. The pouch clasping magnet 232 may be located on the top half of the rear wall 210. The pouch stabilizing magnet 234 may be located on the bottom half of the rear wall 210. The pouch clasping magnet 232 and the pouch stabilizing magnet 234 may prevent the pouch from rotating while coupled to the host object. In some embodiments, the pouch clasping magnet 232 may have a larger surface area than the pouch stabilizing magnet 234.

The plurality of magnets may further comprise a plurality of retainer magnets 240. The plurality of retainer magnets 240 may magnetically couple with the plurality of pouch magnets 230 such that the pouch may be coupled to a non-ferromagnetic object. As a non-limiting example, the plurality of retainer magnets 240 may be placed on a first side of the non-ferromagnetic object such that the pouch may be positioned on a second side of the non-ferromagnetic object with the plurality of pouch magnets 230 attracting the plurality of retainer magnets 240 through the non-ferromagnetic object.

By way of example and not of limitation, the non-ferromagnetic object may be fabric 916 of a tent or a garment 910 such as a shirt. The plurality of retainer magnets 240 may be positioned against the inside surface of the fabric 916 such that the pouch may be coupled to the outside surface of the fabric 916 with the pouch held in place by magnetic attraction between the plurality of pouch magnets 230 and the plurality of retainer magnets 240.

The plurality of retainer magnets 240 may comprise a retainer clasping magnet 242 and a retainer stabilizing magnet 244. The retainer clasping magnet 242 may magnetically couple to the pouch clasping magnet 232. The retainer stabilizing magnet 244 may magnetically couple to the pouch stabilizing magnet 234.

In some embodiments, the pouch clasping magnet 232, the pouch stabilizing magnet 234, the retainer clasping magnet 242, the retainer stabilizing magnet 244, or any combination thereof may be neodymium magnets.

The clip 250 may be formed by folding the pouch in half along a lateral midline such that the upper half of the rear wall 210 is brought adjacent to the lower half of the rear wall 210. Magnetic poles of the pouch clasping magnet 232 and the pouch stabilizing magnet 234 may be oriented in opposite directions such that the north magnetic pole of the pouch clasping magnet 232 faces rearward and the south magnetic pole of the pouch stabilizing magnet 234 faces forward, or vice versa. The clip 250 may be placed over the top of the container such that the pouch clasping magnet 232 is on one side of the container 940 and the pouch stabilizing magnet 234 is on the opposite side of the container 940. The clip 250 may hold the container 940 closed due to the magnetic attraction between the pouch clasping magnet 232 and the pouch stabilizing magnet 234 through the container 940. As a non-limiting example, the container 940 may be the paper bag 942.

In use, a user 950 may couple the pouch to a host object in a number of different ways. If the host object comprises a ferromagnetic surface, the plurality of pouch magnets 230 may be magnetically attached to the ferromagnetic surface. If the host object is a non-ferromagnetic object, the plurality of retainer magnets 240 may be used to capture a portion of the host object between the plurality of pouch magnets 230 and the plurality of retainer magnets 240. Alternatively, the plurality of retainer magnets 240 may be affixed to the host object and the plurality of pouch magnets 230 may be magnetically coupled to the plurality of retainer magnets 240. As non-limiting examples, the plurality of retainer magnets 240 may be coupled to the host object using an adhesive, tape, mechanical interference, mechanical restraint, or any combination thereof.

As non-limiting examples:

- The pouch may be coupled to a kitchen appliance 900 and used to hold a kitchen utensil 902.
- The pouch may be coupled to fabric 916 of a garment 910 such as a shirt and used as a pocket protector to hold a pen 914.
- The pouch may be coupled to the side of a tent and used to hold a flashlight.
- The pouch may be coupled to a mirror 922 or a medicine cabinet in a bathroom 920 and used to hold a razor 926.
- The pouch may be coupled to a cabinet or workbench in a garage and used to hold a tool.

The invention 100 may be used as a clip 250 to hold a container 940 closed by folding the pouch in half and placing the pouch over the top of the container 940 such that the pouch clasping magnet 232 is magnetically attracted to the pouch stabilizing magnet 234. As a non-limiting example, the invention 100 may hold a paper bag 942 closed. The top of the paper bag may be rolled down and the pouch may be folded in half over the top of the paper bag 942 with the pouch clasping magnet 232 and the pouch stabilizing magnet 234 on opposite sides of the paper bag 942. The pouch clasping magnet 232 may magnetically attract the pouch stabilizing magnet 234 such that the top of the paper bag 942 is squeezed by the plurality of pouch magnets 230.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, a "bag" may be a container made of a flexible material. The bag may have one or more openings which allows the bag to receive the items to be contained.

As used herein, the words "couple", "couples", "coupled" or "coupling", may refer to connecting, either directly or indirectly, and does not necessarily imply a mechanical connection.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the word "lateral" may refer to the sides of an object or movement towards a side. Lateral directions are generally perpendicular to longitudinal directions. "Laterally" may refer to movement in a lateral direction.

As used in this disclosure, a "magnet" may be an ore, alloy, or other material that has its component atoms arranged so that the material exhibits properties of magnetism such as attracting iron-containing objects or aligning itself in an external magnetic field.

As used here, the word "midline" may refer to a straight line across the center of a face of an object. An "exact midline" is intended to mean a midline that is equidistant from edges of the face in the direction perpendicular to the midline. Unless otherwise stated, a midline is not required to be at the exact center of the face but instead may be within 20% of the distance from the exact midline to the farthest edge.

As used herein, "non-opaque" may refer to the optical properties of an object which does not block the passage of light. As non-limiting examples, the non-opaque object may be either transparent or translucent.

As used in this disclosure, "orientation" may refer to the positioning and/or angular alignment of a first object relative to a second object or relative to a reference position or reference direction.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used herein, "resilient" or "semi-rigid" may refer to an object or material which may deform when a force is applied to it and which will return to its original shape when the deforming force is removed.

As used in this disclosure, "translucent" may refer to a material that allows light to pass through the material but that significantly scatters the light such that an object cannot be clearly seen through the material.

As used in this disclosure, "transparent" may refer to a material that allows light to pass through the material without significant scattering such that an object can be seen without distortion through the material. "Clear" may be considered to be both transparent and colorless.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A magnetic pouch comprising:

a front wall, a rear wall, and a plurality of magnets;

wherein the front wall is coupled to the rear wall along three edges to form a pouch with an open top;

wherein the plurality of magnets couple the pouch to a host object;

wherein the pouch carries an item such that the item is accessible for use by lifting the item from the pouch;

wherein the plurality of magnets comprise a plurality of pouch magnets that are coupled to the rear wall of the pouch;

wherein the plurality of pouch magnets comprise a pouch clasping magnet and a pouch stabilizing magnet;

wherein a clip is formed by folding the pouch in half along a lateral midline such that the upper half of the rear wall is brought adjacent to the lower half of the rear wall;

wherein magnetic poles of the pouch clasping magnet and the pouch stabilizing magnet are oriented in opposite directions such that the north magnetic pole of the pouch clasping magnet faces rearward and the south magnetic pole of the pouch stabilizing magnet faces forward, or vice versa;

wherein the clip is placed over a top of a container such that the pouch clasping magnet is on one side of the container and the pouch stabilizing magnet is on an opposite side of the container;

wherein the clip holds the container closed due to the magnetic attraction between the pouch clasping magnet and the pouch stabilizing magnet through the container.

2. The magnetic pouch according to claim 1 wherein the front wall and the rear wall are panels.

3. The magnetic pouch according to claim 2 wherein the height of the front wall is at least twice as large as the width of the front wall.

4. The magnetic pouch according to claim 2 wherein the dimensions of the rear wall conform to the dimensions of the front wall;

wherein the front wall and the rear wall are made from one or more semi-rigid materials.

5. The magnetic pouch according to claim 4
wherein the front wall are coupled to the rear wall along a left edge, a right edge, and a bottom edge such that the front wall and the rear wall form the pouch and the open top.

6. The magnetic pouch according to claim 5
wherein the front wall, the rear wall, or both are transparent.

7. The magnetic pouch according to claim 5
wherein the magnetic pouch is operable by folding the pouch in half such that a magnet in the upper half of the rear wall positioned on one side of a container is attracted to a magnet in the lower half of the rear wall positioned on the opposite side of the container.

8. The magnetic pouch according to claim 5
wherein the plurality of pouch magnets detachably couple the pouch to a ferromagnetic surface of the host object by magnetically attracting the ferromagnetic surface.

9. The magnetic pouch according to claim 8
wherein the pouch clasping magnet is located on the top half of the rear wall;
wherein the pouch stabilizing magnet is located on the bottom half of the rear wall.

10. The magnetic pouch according to claim 9
wherein the pouch clasping magnet and the pouch stabilizing magnet prevent the pouch from rotating while coupled to the host object.

11. The magnetic pouch according to claim 10
wherein the plurality of magnets further comprise a plurality of retainer magnets;
wherein the plurality of retainer magnets magnetically couple with the plurality of pouch magnets such that the pouch couples to a non-ferromagnetic object.

12. The magnetic pouch according to claim 11
wherein the plurality of retainer magnets are placed on a first side of the non-ferromagnetic object and the pouch is positioned on a second side of the non-ferromagnetic object with the plurality of pouch magnets attracting the plurality of retainer magnets through the non-ferromagnetic object.

13. The magnetic pouch according to claim 12
wherein the plurality of retainer magnets comprise a retainer clasping magnet and a retainer stabilizing magnet;
wherein the retainer clasping magnet magnetically couples to the pouch clasping magnet;
wherein the retainer stabilizing magnet magnetically couples to the pouch stabilizing magnet.

14. The magnetic pouch according to claim 13
wherein the pouch clasping magnet, the pouch stabilizing magnet, the retainer clasping magnet, the retainer stabilizing magnet, or any combination thereof are neodymium magnets.

15. The magnetic pouch according to claim 13
wherein the pouch formed by the front wall and the rear wall measures 125 mm+/−10 mm high by 50 mm+/−10 mm wide.

16. A magnetic pouch comprising:
a front wall, a rear wall, and a plurality of magnets;
wherein the front wall is coupled to the rear wall along three edges to form a pouch with an open top;
wherein the plurality of magnets couple the pouch to a host object;
wherein the pouch carries an item such that the item is accessible for use by lifting the item from the pouch;
wherein the plurality of magnets comprise a plurality of pouch magnets that are coupled to the rear wall of the pouch;
wherein the plurality of pouch magnets detachably couple the pouch to a ferromagnetic surface of the host object by magnetically attracting the ferromagnetic surface;
wherein the pouch is magnetically coupled to the host object in a vertical orientation with the open top positioned at the top of the pouch;
wherein the plurality of pouch magnets comprise a pouch clasping magnet and a pouch stabilizing magnet;
wherein a clip is formed by folding the pouch in half along a lateral midline such that an upper half of the rear wall is brought adjacent to a lower half of the rear wall;
wherein magnetic poles of the pouch clasping magnet and the pouch stabilizing magnet are oriented in opposite directions such that a north magnetic pole of the pouch clasping magnet faces rearward and a south magnetic pole of the pouch stabilizing magnet faces forward, or vice versa;
wherein the clip is placed over a top of a container such that the pouch clasping magnet is on one side of the container and the pouch stabilizing magnet is on an opposite side of the container;
wherein the clip holds the container closed due to the magnetic attraction between the pouch clasping magnet and the pouch stabilizing magnet through the container.

17. The magnetic pouch according to claim 16
wherein the front wall and the rear wall are rectangular panels;
wherein the height of the front wall is at least twice as large as the width of the front wall
wherein the dimensions of the rear wall conform to the dimensions of the front wall;
wherein the front wall and the rear wall are made from one or more semi-rigid materials.

18. The magnetic pouch according to claim 17
wherein the front wall are coupled to the rear wall along a left edge, a right edge, and a bottom edge such that the front wall and the rear wall form the pouch and the open top;
wherein the front wall, the rear wall, or both are made from a non-opaque material;
wherein the front wall, the rear wall, or both are transparent.

19. The magnetic pouch according to claim 17
wherein the plurality of magnets further comprise a plurality of retainer magnets;
wherein the plurality of retainer magnets magnetically couple with the plurality of pouch magnets such that the pouch couples to a non-ferromagnetic object;
wherein the plurality of retainer magnets are placed on a first side of the non-ferromagnetic object and the pouch is positioned on a second side of the non-ferromagnetic object with the plurality of pouch magnets attracting the plurality of retainer magnets through the non-ferromagnetic object.

20. The magnetic pouch according to claim 17
wherein the plurality of retainer magnets comprise a retainer clasping magnet and a retainer stabilizing magnet;
wherein the retainer clasping magnet magnetically couples to a pouch clasping magnet;
wherein the retainer stabilizing magnet magnetically couples to the pouch stabilizing magnet.

21. The magnetic pouch according to claim 20
wherein the pouch clasping magnet, the pouch stabilizing magnet, the retainer clasping magnet, the retainer stabilizing magnet, or any combination thereof are neodymium magnets.

22. The magnetic pouch according to claim 16
wherein the pouch clasping magnet is located on the top half of the rear wall;
wherein the pouch stabilizing magnet is located on the bottom half of the rear wall;
wherein the pouch clasping magnet and the pouch stabilizing magnet prevent the pouch from rotating while coupled to the host object.

* * * * *